United States Patent [19]

Bahr et al.

[11] 4,359,484

[45] Nov. 16, 1982

[54] PROCESS FOR REDUCING TRACES OF ABRASION OR SCRATCHES ON THE SURFACE OF A RECORD CARRIER

[75] Inventors: Dietrich J. Bahr, Herrenberg; Marian Briska, Böblingen, both of Fed. Rep. of Germany

[73] Assignee: International Business Machines Corporation, Armonk, N.Y.

[21] Appl. No.: 238,289

[22] Filed: Feb. 25, 1981

[30] Foreign Application Priority Data

Mar. 26, 1980 [DE] Fed. Rep. of Germany ..... 3011591

[51] Int. Cl.[3] ..... C10M 5/16; C10M 5/14; C10M 7/20; C10M 7/22

[52] U.S. Cl. ..... 427/14.1; 252/35; 252/39; 252/41; 346/1.1; 346/135.1; 346/150; 427/156

[58] Field of Search ..... 427/156, 14.1; 252/35, 252/39, 41; 346/1, 135.1

[56] References Cited

U.S. PATENT DOCUMENTS 4,193,881 3/1980 Baur ..... 252/35 X

*Primary Examiner*—Michael R. Lusignan

*Attorney, Agent, or Firm*—Joseph G. Walsh

[57] ABSTRACT

The invention concerns a process for reducing, or completely eliminating, traces of abrasion or scratches on the surface of a record carrier covered with a thin metallic layer, preferably consisting of aluminum. The process is characterized in that the surface of the record carrier is covered with a 2 to 1000 nm thick layer of a metallic soap, preferably a saturated metallic soap, an unsaturated metallic soap or a mixture thereof.

8 Claims, No Drawings

PROCESS FOR REDUCING TRACES OF ABRASION OR SCRATCHES ON THE SURFACE OF A RECORD CARRIER

DESCRIPTION

1. Technical Field

The invention concerns a process for reducing or completely eliminating traces of abrasion or scratches on the surface of a record carrier covered with a thin metallic layer preferably consisting of aluminum.

During the electrographic printing on a foil covered with an aluminum layer or on paper covered with an aluminum layer and a lacquer layer, it is necessary for the print electrodes to be in direct electric contact with the aluminum layer. Almost all printers are designed for continuous printing, i.e., there is always a relative movement between the print electrodes and the aluminum-coated record carrier. The electric contact between the electrodes and the aluminum-coated record carrier must also be ensured during this relative movement, i.e., the electrodes grind against the aluminum layer, regardless of whether or not printing actually takes place. In the areas in which the aluminum is not eroded, i.e., evaporated, this grinding leads to traces of abrasion or scratches, the magnitude and nature of which depend on the roughness structure and the materials used during the manufacture of the record carrier on the one hand and on the size and arrangement of the individual electrodes on the other. In particular, with very thin electrodes for high-quality printing, marked traces occur as a result of the relatively high pressure per unit area. In the most favorable case, such traces are optically objectionable, whereas in the most unfavorable case, they prevent the printed record carrier from being reproduced, for example, by copying.

2. Prior Art

It is known that lubricants on the aluminum layer reduce such traces of abrasion or scratches more or less effectively. Layers of oil, grease, wax and metal oxides, have been proposed, as may be seen in detail, for example, from GE PS No. 849 609 and GE AS Nos. 1 011 722, 1 014 128 and 1 025 259.

Because of their insulating properties, such layers are not advantageous for printing. They are either too thick, in that case they are used as insulating layers, or too thin and thus ineffective, or if they consist of liquid materials, they are absorbed after a certain time by the lacquer layer and the paper. It is also known that for reducing abrasion at high pressures per unit area, soap is one of the stablest and cheapest lubricants.

In German patent application No. P 30 07 331.5, it has already been proposed to cause aluminum and a fatty acid to react to obtain aluminum soap, thus forming a soap layer of aluminum oleate, which acts as a lubricant, in particular on the surface. The high degree of efficiency of such a layer has been confirmed by a great number of tests carried out. However, aluminum soap is insoluble in water and, in accordance with the older proposal, permanently integrated in the aluminum layer. This means, for subsequently printing other characters, the non-printed parts of the record carrier would have to be hydrophilic, so that the hydrophobic aluminum soap could not be removed without damaging the only about 30 to 40 nm thick aluminum layer. In addition, the thickness of this, at best monomolecular, soap layer might be too small for very high pressures.

Tests carried out under the scanning electron microscope have shown that during the erosion process in electroerosion printers, metallic aluminum is deposited on the front faces of the electrodes where it solidifies, subsequently rubbing off in the unprinted areas of the paper and thus leading to particularly severe scratches.

DISCLOSURE OF THE INVENTION

Therefore, it is the object of the invention to provide a novel process for reducing or completely eliminating scratches and traces of abrasion on the surface of a record carrier covered with an aluminum layer. In accordance with the invention, this problem is solved by applying an about 2 to 1000 nm thick layer of a metallic soap to the surface of the aluminum layer. For this purpose, saturated metallic soaps, unsaturated metallic soaps or mixtures of saturated and unsaturated metallic soaps are used. Particularly suitable are one or several metallic soaps of the groups consisting of stearates, palmitates, oleates, linoleates, resinates, laurates and naphthenates. Depending upon the respective application, hydrophilic or hydrophobic soap will be used in this connection. Also depending upon the respective application, soap soluble or insoluble in water will be used.

Particularly advantageous is the use of a soap whose metal component is tin, zinc, magnesium or lithium.

It is pointed out that it is particularly favorable for the metallic soap to be applied in such a manner that the inherent unevenness, i.e., the roughness of the record carrier surface is essentially leveled out and compensated.

It is to be considered, however, that metallic soaps as such are poor conductors. As metallic soaps melt in any case at maximum temperatures above 200°, they act as an electrolyte at the high temperatures occurring at the electrode tips, i.e., they conduct the electric current.

The novel process has quite a number of advantages. First of all, the soap layers which are subsequently applied are very easy to produce and, by suitably selecting the metallic soap, may be either hydrophilic or hydrophobic. They may be removable by water or resistant to it. A particular advantage is that by suitably selecting the metal components of the metallic soap, the melting point of the aluminum can be favorably influenced. When using, for example, a soap whose metal components are tin, zinc, magnesium or lithium, the basic metal is reduced more or less extensively as a result of the high temperatures occurring at the electrodes. This leads to the formation of a eutectic alloy of aluminum and lithium and thus to a noticeable decrease in the eutectic melting point. The aluminum adhering to the front faces of the electrodes as a result of the erosion process and which solidifies very rapidly could be kept liquid for a longer period of time, preferably until after it has been rubbed off on the unprinted record carrier surfaces. Generally, the aluminum solidifies immediately after erosion and has to be rubbed off on the unprinted surfaces, leading to ugly traces of abrasion and scratches.

These soaps can also be used to change the reflectance behavior of the aluminum surface towards diffuse reflection. The metallic soaps are also suitable for absorbing individual wavelengths from the continuous spectrum.

As tests carried out with the novel coatings of metallic soaps on record carrier surfaces have shown in a very surprising manner, traces of abrasion and scratches previously encountered are eliminated completely, i.e., even when the surfaces are highly magnified, there is no detectable abrasion, regardless of whether the soap layer remains on the surface after printing or is washed off in the case of water soluble soaps.

We claim:

1. A process for reducing traces of abrasion during printing operations in an electrographic printer, on the surface of a record carrier covered with a thin evaporated aluminum layer, said process being characterized in that a thin layer of about 2 nm to 1000 nm of a metallic soap is applied to said layer in such a manner that the inherent unevenness of the surface of the record carrier is essentially leveled out and compensated.

2. A process in accordance with claim 1, characterized in that saturated metallic soaps, unsaturated metallic soaps or mixtures thereof are used.

3. A process in accordance with claim 1, characterized in that a metallic soap selected from the group consisting of stearates, palmitates, oleates, linoleates, resinates, laurates and naphthenates is used.

4. A process in accordance with claim 1, characterized in that a hydrophilic soap is used.

5. A process in accordance with claim 1, characterized in that a hydrophobic soap is used.

6. A process in accordance with claim 1, characterized in that a water-soluble soap is used.

7. A process in accordance with claim 1 characterized in that a soap insoluble in water is used.

8. A process in accordance with claim 1, characterized in that a soap of tin, zinc, lithium or magnesium is used.

* * * * *